US010664003B2

(12) United States Patent
Geilsdorf et al.

(10) Patent No.: US 10,664,003 B2
(45) Date of Patent: May 26, 2020

(54) INDUSTRIAL TRUCK WITH OPERATING ASSEMBLY AND ASSOCIATED METHOD

(71) Applicant: Jungheinrich Aktiengesellschaft, Hamburg (DE)

(72) Inventors: Hendrick Geilsdorf, Hamburg (DE); Jörn Sellentin, Kaltenkirchen (DE)

(73) Assignee: Jungheinrich Aktiengesellschaft, Hamburg (DE)

( * ) Notice: Subject to any disclaimer, the term of this patent is extended or adjusted under 35 U.S.C. 154(b) by 309 days.

(21) Appl. No.: 15/720,528

(22) Filed: Sep. 29, 2017

(65) Prior Publication Data

US 2018/0088620 A1 Mar. 29, 2018

(30) Foreign Application Priority Data

Sep. 29, 2016 (DE) ..... 10 2016 118 459

(51) Int. Cl.

| | |
|---|---|
| ***G05G 5/05*** | (2006.01) |
| ***G05G 5/03*** | (2008.04) |
| ***G05G 5/04*** | (2006.01) |
| ***G05G 9/047*** | (2006.01) |
| *B66F 9/20* | (2006.01) |

(52) U.S. Cl.

CPC ..... *G05G 5/05* (2013.01); *G05G 5/03* (2013.01); *G05G 5/04* (2013.01); *G05G 9/047* (2013.01); *B66F 9/20* (2013.01); *G05G 2009/04766* (2013.01)

(58) Field of Classification Search

CPC . G05G 5/05; G05G 5/03; G05G 9/047; B66F 9/20

See application file for complete search history.

(56) References Cited

U.S. PATENT DOCUMENTS

| | | | | |
|---|---|---|---|---|
| 3,679,846 A * | 7/1972 | Dillon | H01H 25/04 | 200/6 A |
| 5,410,931 A * | 5/1995 | Pecceu | F16H 59/044 | 74/335 |
| 5,852,953 A * | 12/1998 | Ersoy | F16H 59/0204 | 74/473.12 |
| 6,109,130 A | 8/2000 | Will | | |
| 7,640,823 B2 * | 1/2010 | Bowman | F16H 59/0204 | 74/471 XY |

(Continued)

FOREIGN PATENT DOCUMENTS

| | | |
|---|---|---|
| DE | 19753867 A1 | 6/1999 |
| DE | 102005000633 A1 | 7/2006 |

(Continued)

*Primary Examiner* — David M Fenstermacher

(74) *Attorney, Agent, or Firm* — Barclay Damon LLP

(57) ABSTRACT

An operating assembly for an industrial truck comprises an operating lever and a resetting apparatus. The resetting apparatus is configured to interact with the operating lever to generate a resetting force for the operating lever that is dependant on its deflection. The resetting appatratus further defines a stop section for the deflection of the operating lever. The stop section comprises a rising edge and a falling edge, wherein the resetting force is reduced by a first additional stop force in the falling edge and increased by a second additional stop force in the rising edge.

18 Claims, 3 Drawing Sheets

(56) References Cited

U.S. PATENT DOCUMENTS

| | | | | |
|---|---|---|---|---|
| 7,900,534 | B2 * | 3/2011 | Kusayama | F16H 59/02 74/471 XY |
| 9,970,530 | B2 * | 5/2018 | Polan | F16H 59/044 |
| 2015/0033899 | A1 | 2/2015 | Geilsdorf et al. | |
| 2015/0268691 | A1 | 9/2015 | Schaub et al. | |

FOREIGN PATENT DOCUMENTS

| | | | |
|---|---|---|---|
| DE | 102011110081 | A1 | 2/2013 |
| DE | 10213012176 | A1 | 1/2015 |
| DE | 102014103988 | A1 | 9/2015 |
| EP | 2178098 | A1 | 4/2010 |
| FR | 2890464 | A1 | 3/2007 |

* cited by examiner

INDUSTRIAL TRUCK WITH OPERATING ASSEMBLY AND ASSOCIATED METHOD

CROSS REFERENCE TO RELATED INVENTION

This application is based upon and claims priority to, under relevant sections of 35 U.S.C. § 119, German Patent Application No. 10 2016 118 459.4, filed Sep. 29, 2016, the entire contents of which are hereby incorporated by reference.

BACKGROUND

The present invention relates to an industrial truck with operating assembly comprising an operating lever and a method for operating such an industrial truck.

Numerous different concepts and approaches are known for operating and controlling industrial trucks. For example, a control element for an industrial truck is known from DE 10 2013 012 176 that has two operating levers and at least one switch arranged therebetween. The operating levers are each designed for a bi-axial movement and are spatially separate from each other such that the fingers of a hand positioned between the levers can actuate the operating levers without grasping, and can actuate the at least one switch between the operating levers.

DE 10 2005 000 633 A1 has disclosed providing vibration in the control element and/or the driver's seat as feedback for vehicle states and/or vehicle information. This is haptic feedback of vehicle states and/or vehicle information. When the control element is embodied as a joystick, there is reliable and direct feedback of vehicle states and/or vehicle information by electromagnets generating vibrations, or an electric motor interacting with an unbalanced mass.

Control elements designed as a joystick are known from DE 10 2014 103 988 A1 for controlling commercial vehicles, machines, work functions of commercial vehicles or construction machines and attachments. The use of force feedback is also known for the joysticks. Force feedback is mechanical feedback which is normally achieved by coupled torque of an electric motor with the assistance of a gear unit. Different technical embodiments of the actuating lever of the joystick are known for implementing force feedback.

The objective of the invention is to provide an industrial truck and method to operate it that is equipped with very simple means for intuitive and reliable operation.

BRIEF SUMMARY OF THE INVENTION

In an embodiment, tan industrial truck is equipped with operating means (or operating assembly) comprising an operating lever and a resetting apparatus configured to interact with the operating lever and generate a resetting force for the operating lever depending on its deflection. In an embodiment, a stop section for the resetting apparatus is provided in which the resetting force is reduced by a first stop force in a falling edge, and increased by a second stop force in a rising edge. The stop section results from the curve of the resetting force depending on the deflection in comparison to a substantially proportional curve. Given a substantially proportional curve, the resetting force increases as the deflection increases. In a stop section for the deflection, the resetting force is increased relative to this proportionality. In the stop section, a force progression exists in which the resetting force decreases as the deflection increases in a falling edge before it rises as the deflection continues to increase in a rising edge. This creates a feeling for the user of passing through a stop point of the operating lever. A resetting force prevails in the stop point; however, the resetting force increases overproportionally when the operating lever moves out of the stop point. The resetting forces are adjusted and specified in the vehicle according to the invention by means of the resetting apparatus. Preferably, the first and second resetting force are the same size.

In an embodiment, the control means may comprise a state switch. The state switch can be switched by overcoming the stop section. Whether this is overcome with a rising or falling deflection can be defined for the state switch. A different state of the industrial truck can be switched to depending on the direction of the deflection movement.

In another embodiment, the control means may comprise a state switch that is switched by holding the operating lever in its stop section. With this state switch, a corresponding state is not switched to by passing through the stop section and overcoming an additional stop force, but rather by holding the operating lever in the stop section. Preferably, the state switch is used to switch between different vehicle functions or operating modes for a vehicle function. The operating modes can designate a different mode of one and the same vehicle function.

In an embodiment, a first deflection section is provided with deflections that are less than the deflection of the stop section. This means that starting from a neutral position, there is a section of deflection before the stop section is reached as deflection increases.

In an embodiment, a second deflection section is provided with a deflection that is greater than the deflection of the stop section. A deflection section can be provided after passing through the stop section. The stop point can of course be provided for a combination of the first and second deflection section even for a middle deflection so that both a first and a second deflection section are provided.

In an embodiment, only one first or one second deflection section is provided, wherein an additional vehicle function is activated as long as the deflection of the operating lever is within the stop section. In this embodiment, the stop section is located at the beginning or the end of the deflection of the operating lever. By holding the operating lever in the stop section, an additional vehicle function or operating mode is activated.

In another embodiment, only a first or second deflection section is provided, and an additional vehicle function or operating mode is switched to by passing through the stop section one or more times. In this case, the additional vehicle function or the operating mode is executed for a predetermined time independent of a deflection of the operating lever. In this embodiment, the operating lever does not activate the additional vehicle function. Instead, the additional vehicle function or operating mode is switched to and executed, for example, for a predetermined time independent of operating lever deflection.

In an embodiment, it is possible for the additional vehicle function or the operating mode to be executed for a predetermined time depending on a deflection of the operating lever.

In an embodiment, a first and a second deflection section can be provided, wherein the additional vehicle function or operating mode is activated as long as the deflection of the operating lever is within the stop section. The stop section is positioned in the middle and separates a first and second deflection section. Holding the operating lever in the stop section switches to and activates an additional vehicle function or operating mode as long as the deflection of the operating lever is in the stop section.

In another embodiment, by passing through the stop section one or more times, an additional vehicle function or operating mode can be switched to, which is executed for a predetermined time independent of the deflection of the operating lever. Alternatively, it is also possible to execute the additional vehicle function or operating mode depending on the deflection of the operating lever.

In an embodiment, passing through the stop section terminates the additional vehicle function or operating mode. This can be provided as a form of an emergency stop. The objective according to the invention is also achieved by a method for operating an industrial truck.

The method according to the invention serves to operate an industrial truck comprising an operating means having a operating lever and a resetting apparatus that is configured to interact with the operating lever and produce a resetting force for the operating lever that is dependent on its deflection. In an embodiment, the operating lever may also comprise a stop section for its deflection in which the resetting force is increased by an additional resetting force.

In an embodiment, switching occurs by overcoming the additional stop force or by holding the deflection in the stop section. Switching may activate an additional vehicle function, or change to a different operating mode. By overcoming the stop force, a switched vehicle function or operating mode may be terminated.

BRIEF DESCRIPTION OF THE DRAWINGS

The invention will be further explained below using a preferred exemplary embodiment. In the following.

DETAILED DESCRIPTION OF THE INVENTION

Figure 1:
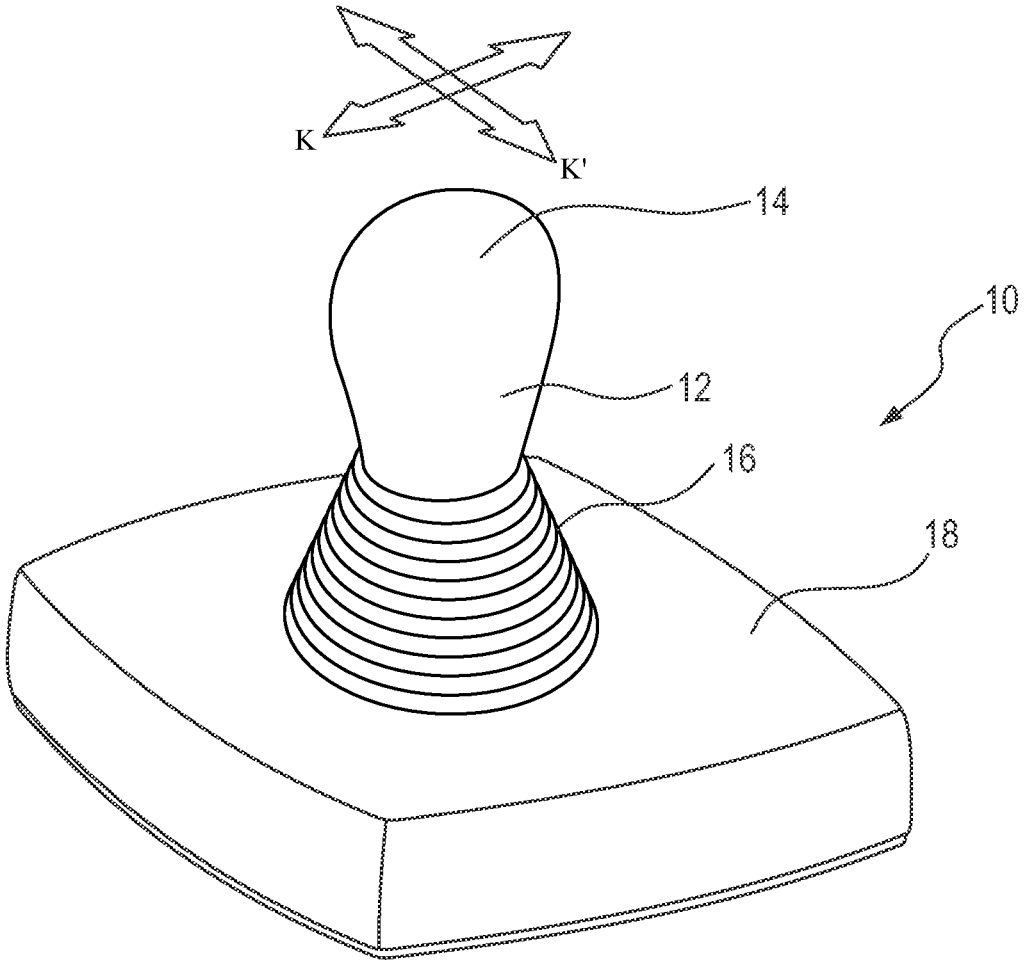
FIG. 1 illustrates a perspective view of an embodiment of an operating lever for an industrial truck.

FIG. 1 shows an embodiment of an operating means (or operating assembly) 10 comprising an operating lever 12. The operating lever 12 comprises a lever head 14 that is rounded or ball-shaped for ergonomically convenient handling. The lever head 14 of the operating lever 12 can be pivoted along two axes K, K' independent of each other relative to a base frame 18. An elastic sleeve 16 is disposed around a foot of the operating lever 12 which protects the lever foot of the operating lever 12 from contaminants.

Two deflections in a positive and negative directions can be executed with the operating lever. The movements in both directions, which are perpendicular to each other can be executed independent of each other and thereby overlapped. The invention can already be designed in a positive or negative direction with an operating lever having a one-dimensional deflection.

Figure 2:
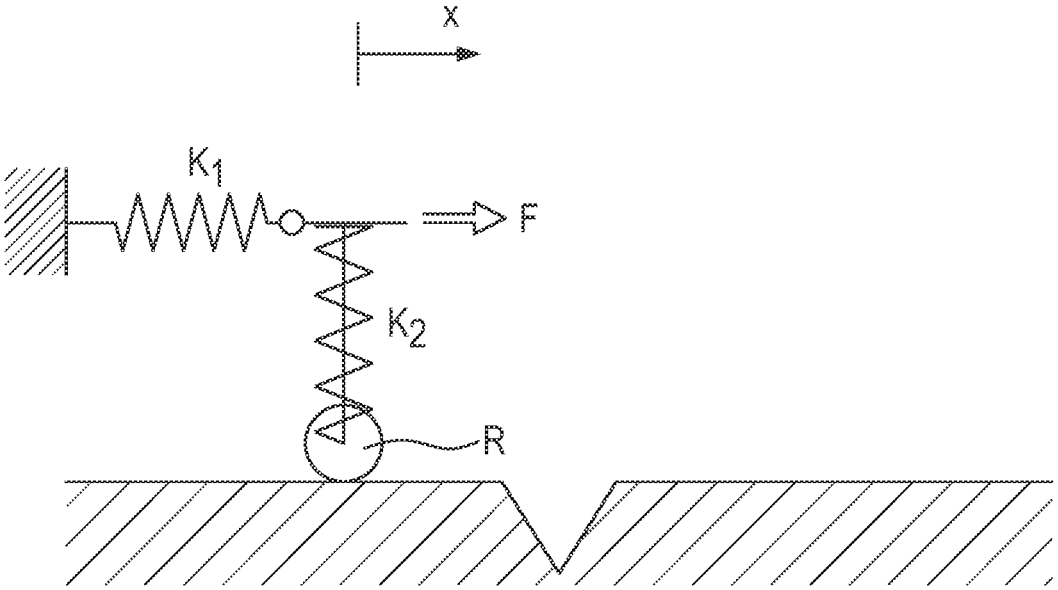
FIG. 2 illustrates a model of an embodiment of a stop section.

FIG. 2 depicts a model of the behavior of the operating lever 12 (FIG. 1) in the stop section. To deflect the operating lever 12 (FIG. 1), it is moved in the X-direction against a spring K1. As the deflection increases in the X-direction, the spring force increases proportionally. In addition, a second spring K2 is provided, at the bottom end of which a wheel R is schematically depicted. The wheel R rolls on the flat base so that the spring K2 on a flat base does not contribute to the resetting force or to the force F counteracting it. The stop section is identified by a recess in the base. The spring K2 extends into this recess in the base and provides a force that counteracts the spring force K1 due to the slope. The sum of the forces is experienced as a decreasing resetting force. If the wheel R moves out of the recess, a force component of the spring K2 that reinforces the spring force K1, and hence an increasing resetting force arises. Passing through the recess in the base creates the feeling in the user that a stop point has been passed through. This feeling of operation occurs when the recess is passed through with large deflections from a small extension of the force K1, as well as when the recess is passed through in smaller deflections coming from larger deflections.

Figure 3:
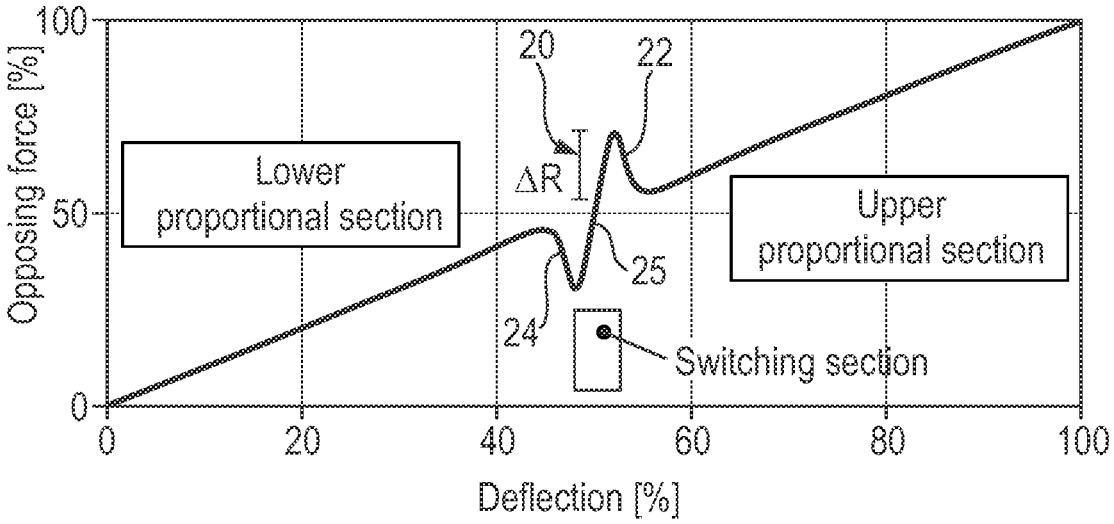
FIG. 3 illustrates a curve depicting the relationship between the resetting force and the deflection of the operating lever in a middle stop section.

FIG. 3 shows the curve of a resetting force depending on the deflection of the operating lever 12 (FIG. 1) in arbitrarily scaled units. Here, the units are scaled so that the provided maximum resetting force of 100% is applied in a maximum deflection of 100%. The relationship between the deflection and resetting force shown in FIG. 3 has a lower proportionality section for a deflection of 0% to 40%, and an upper proportionality section for a deflection from 60% to 100%. In the section of the deflection from 40% to 60%, the resetting force decreases at a deflection of approximately 45% despite the increasing deflection. This is followed by a steeply increasing resetting force that at about a 55% deflection again decreases in a falling edge as the deflection increases in transitioning into the upper proportionality section.

As shown, the lower and upper proportionality section have approximately the same slope. This, however, as in another embodiment the proportionality sections may have different slopes. In the stop section 20, there is an additional resetting force ΔR to be overcome. The stop section 20 moreover may comprise two falling edges 22 and 24 in which the resetting force decreases as the deflection increases. Due to the falling edges 22 and 24, the additional stop force ΔR to be overcome is distinctly perceptible. Between the falling edges 22, 24, there is a rising edge 25 in which the resetting force increases overproportionally with the deflection. Since initially a reversal of the falling and rising resetting forces is generated both when there is an increasing and decreasing deflection in the stop section with the falling edges 22, 24, the edge 25 can be perceived as a stop section.

Of particular interest is the generation of stop points by a resetting device interacting with the operating lever 12 (FIG. 1) in industrial trucks with semiautomated functions. Such semiautomated functions are, for example, the preselection of lifting height in which the vehicle lifts the load up to a set lifting height and independently stops at said height. The function of making a mast of an industrial truck vertical may be executed as a semiautomated function that independently vertically aligns the lifting mast.

The semi-automated function may be triggered by the operating lever 12 (FIG. 1). Triggering the preselection of the lifting height may be accomplished by slightly pulling back the operating lever 12 (FIG. 1) close to the lifting height to be approached. The vehicle ascertains the slight pulling back on the operating lever 12 (FIG. 1) and then independently approaches the preselected lifting height.

Switching can occur by passing through or holding the operating lever 12 (FIG. 1) in the stop section. As shown in FIG. 3, when the stop section is provided in the middle of the deflection, the lower and upper proportional sections result in which the functions can be operated, or respectively activated as usual. A provided automated function is only activated when the operating lever 12 (FIG. 1) is held in the stop point for at least a specific period. The operating lever 12 (FIG. 1) can be held in a switching section of the stop point that for example is defined by the rising edge 25. The automated function is started when the operating lever 12 (FIG. 1) is held sufficiently long in the stop section, wherein the period is selected so as to avoid unintentional activation.

In an embodiment, the automated function may be executed as long as the operating lever 12 (FIG. 1) is held in the switching section. The automated function may be terminated when the operating lever 12 (FIG. 1) is removed from the switching section.

In an embodiment, the automated function may be executed at an established speed until a specified end no matter how the operating lever 12 (FIG. 1) is moved. This function may execute a predetermined automatic mode that cannot be influenced by the vehicle driver.

In an embodiment, the automated function may be executed until a specific end, wherein the proportionality sections can control the speed of execution. This allows the user to execute the automated function (e.g., faster or slower).

Figure 4:
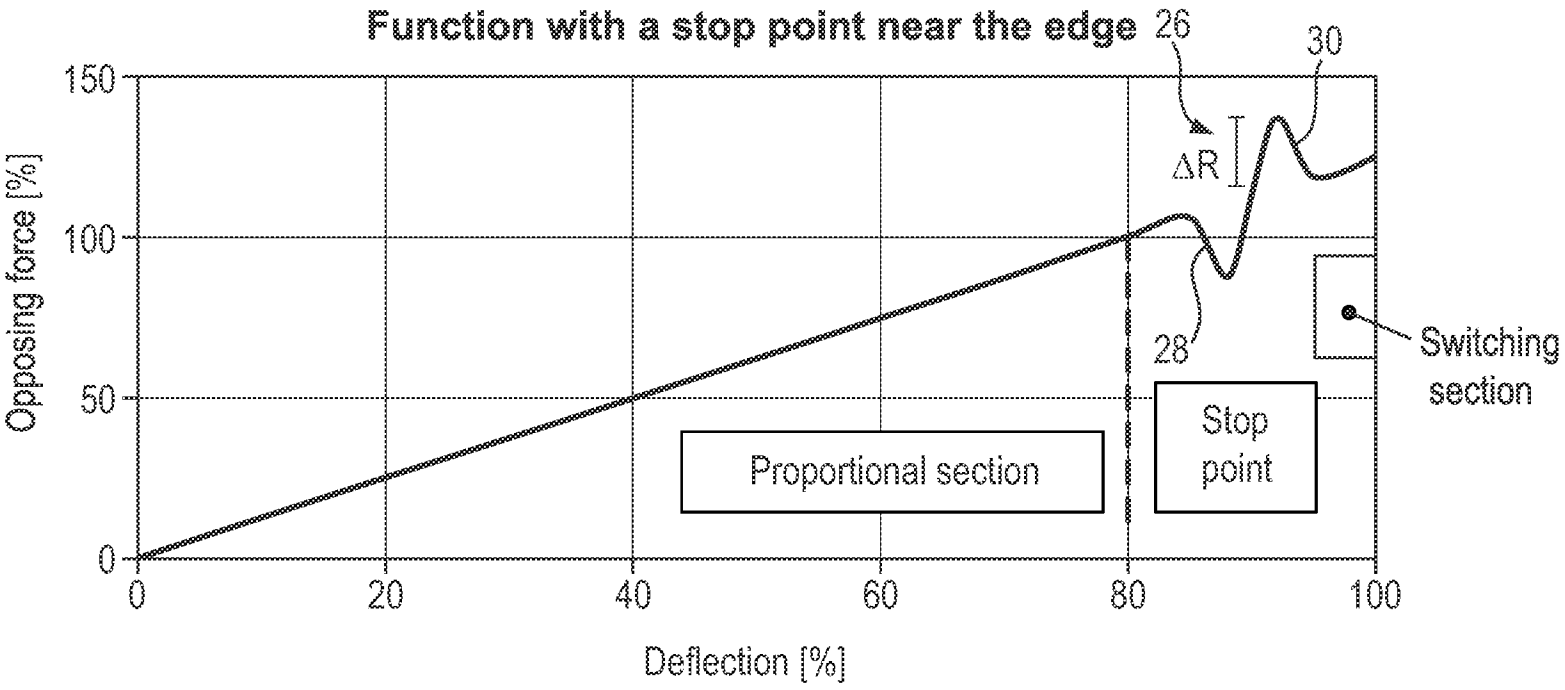
FIG. 4 illustrates a curve depicting the relationship between the resetting force and the deflection in an end-side stop section.

An operating function being executed can be terminated by passing through the stop section. FIG. 4 shows the relationship between the resetting force and deflection when the stop point is at the end which occurs at a deflection greater than 80%. The configuration of the stop section 26 corresponds to the stop section from FIG. 3 with two falling edges 28 and 30. As shown in FIG. 4, the switching section is for deflections greater than the falling edge 30 (i.e., for deflections close to 100%). To reach the switching section, the stop section 26 must be passed through, and the operating lever 12 (FIG. 1) must be above the stop section 26.

Still referring to FIG. 4, the additional stop force ΔR may be used as a switch which is passed through to switch to the following switching section.

REFERENCE LIST

10 Operating means
12 Operating lever
14 Lever head
16 Elastic sleeve
18 Base frame
20 Stop section
22 Edges
24 Edges
26 Stop section
28 Edges
30 Edges

The invention claimed is:

1. An operating assembly for an industrial truck, the operating assembly comprising:

an operating lever; and a resetting apparatus configured to interact with the operating lever to produce a resetting force for the operating lever that is dependent on the deflection of the operating lever, the resetting apparatus further defining a stop section for the deflection of the operating lever comprising a rising edge and a falling edge, wherein the resetting force is reduced by a first additional stop force in the falling edge and increased by a second additional stop force in the rising edge.

2. The operating assembly according to claim 1, wherein the operating assembly further comprises a state switch configured to be switched by overcoming the stop section.

3. The operating assembly according to claim 1, wherein the operating assembly further comprises a state switch configured to be switched by holding the operating lever in the stop section.

4. The operating assembly according to claim 2, wherein the state switch is configured to switch between different vehicle functions.

5. The operating assembly according to claim 1, further comprising a first deflection section for deflections of the operating lever that are less than the deflection of the stop section.

6. The operating assembly according to claim 5, further comprising a second deflection section for deflections of the operating lever that are greater than the deflection of the stop section.

7. The operating assembly according to claim 1, further comprising an additional vehicle function configured to be activated by maintaining the deflection of the operating lever within the stop section.

8. The operating assembly according to claim 7, wherein holding the operating lever in the stop section for at least a predetermined time switches to the additional vehicle function.

9. The operating assembly according to claim 1, further comprising an additional vehicle function configured to be activated by passing through the stop section one or more times.

10. The operating assembly according to claim 1, further comprising an additional vehicle function configured to be activated for a predetermined time independent of the deflection of the operating lever.

11. The operating assembly according to claim 6, further comprising an additional vehicle function that is configured to be activated by passing through the stop section one or more times.

12. The operating assembly according to claim 11, wherein the additional vehicle function is executed for a predetermined time depending on a deflection of the operating lever.

13. The operating assembly according to claim 11, wherein the additional vehicle function is executed for a predetermined time independent of a deflection of the operating lever.

14. The operating assembly according to claim 7, wherein passing through the stop section terminates the additional vehicle function.

15. A method for operating an industrial truck having an operating lever and a resetting device configured to interact with the operating lever and generate a resetting force for the operating lever depending on the deflection of the operating lever, the method comprising:

defining a stop section based on the deflection, the stop section configured to reduce the resetting force by a first additional stop force in a falling edge, and wherein the stop section is configured to increase the resetting force by a second additional stop force in a rising edge.

16. The method according to claim 15, wherein the stop section is configured to be switched to by overcoming the resetting force reduced by first additional stop force.

17. The method according to claim 15, wherein the stop section is configured to be switched to by holding the operating lever in the stop section.

18. The method according to claim 15, wherein an enabled vehicle function is terminated by overcoming the resetting force increased by a second additional stop force.

* * * * *